US010544941B2

(12) United States Patent
Stoia et al.

(10) Patent No.: US 10,544,941 B2
(45) Date of Patent: Jan. 28, 2020

(54) FUEL NOZZLE ASSEMBLY WITH MICRO-CHANNEL COOLING

(71) Applicant: General Electric Company, Schenectady, NY (US)

(72) Inventors: Lucas John Stoia, Taylors, SC (US); Richard Martin DiCintio, Greenville, SC (US); Timothy James Purcell, Greenville, SC (US); Srikanth Chandrudu Kottilingam, Greenville, SC (US)

(73) Assignee: General Electric Company, Schenectady, NY (US)

( * ) Notice: Subject to any disclaimer, the term of this patent is extended or adjusted under 35 U.S.C. 154(b) by 169 days.

(21) Appl. No.: 15/371,308

(22) Filed: Dec. 7, 2016

(65) Prior Publication Data

US 2018/0156462 A1 Jun. 7, 2018

(51) Int. Cl.

| | |
|---|---|
| ***F23R 3/28*** | (2006.01) |
| ***F23D 11/40*** | (2006.01) |
| *F23D 14/64* | (2006.01) |
| *F23D 14/62* | (2006.01) |

(52) U.S. Cl.

CPC ..... *F23R 3/283* (2013.01); *F23R 3/286* (2013.01); *F23D 11/40* (2013.01); *F23D 14/62* (2013.01); *F23D 14/64* (2013.01); *F23D 2214/00* (2013.01)

(58) Field of Classification Search

CPC ..... F23D 2214/00; F23D 14/76; F23D 14/78; F23R 3/286

See application file for complete search history.

(56) References Cited

U.S. PATENT DOCUMENTS

| | | | | |
|---|---|---|---|---|
| 5,080,712 | A | 1/1992 | James et al. | |
| 8,167,558 | B2 * | 5/2012 | Liang | F01D 5/187 415/115 |
| 8,756,934 | B2 * | 6/2014 | Melton | F23R 3/28 60/737 |
| 9,015,944 | B2 | 4/2015 | Lacy et al. | |
| 9,316,398 | B2 * | 4/2016 | Nilsson | F23R 3/343 |
| 2003/0235494 | A1 * | 12/2003 | Draper | F01D 5/185 415/115 |
| 2006/0210390 | A1 * | 9/2006 | Draper | F23R 3/005 415/115 |

(Continued)

OTHER PUBLICATIONS

Co-Pending U.S. Appl. No. 15/289,242, filed Oct. 10, 2016.
Co-Pending U.S. Appl. No. 15/289,247, filed Oct. 10, 2016.

*Primary Examiner* — Todd E Manahan
*Assistant Examiner* — Todd N Jordan
(74) *Attorney, Agent, or Firm* — Frank A. Landgraff; Charlotte C. Wilson; James W. Pemrick

(57) ABSTRACT

A fuel nozzle assembly includes a forward plate and an aft plate which is axially spaced from the forward plate. The aft plate includes a first side surface and a second side surface. A cooling air plenum is defined within the bundled tube fuel nozzle assembly and is at least partially defined by the aft plate. A plurality of tubes extends through the forward plate, the cooling air plenum and the aft plate. A micro-cooling channel is disposed along the second side surface of the aft plate and is in fluid communication with the cooling air plenum and is in fluid communication with an exhaust aperture. A cover plate is connected to the aft plate and covers the micro-cooling channel.

20 Claims, 6 Drawing Sheets

(56) References Cited

U.S. PATENT DOCUMENTS

| | | | | |
|---|---|---|---|---|
| 2010/0300106 | A1* | 12/2010 | Edwards | F23R 3/10 60/752 |
| 2011/0180199 | A1 | 7/2011 | Huxol et al. | |
| 2013/0045452 | A1 | 2/2013 | Costa et al. | |
| 2013/0084534 | A1* | 4/2013 | Melton | F23R 3/10 431/2 |
| 2014/0053571 | A1* | 2/2014 | Keener | F23R 3/10 60/782 |
| 2014/0170433 | A1* | 6/2014 | Schick | B22F 7/08 428/548 |
| 2014/0237784 | A1 | 8/2014 | Lacy et al. | |
| 2015/0241064 | A1* | 8/2015 | Boardman | F23R 3/283 60/737 |
| 2015/0285501 | A1* | 10/2015 | DiCintio | F23R 3/14 60/740 |
| 2015/0369068 | A1 | 12/2015 | Kottilingam et al. | |
| 2015/0377037 | A1 | 12/2015 | Salm et al. | |

* cited by examiner

FUEL NOZZLE ASSEMBLY WITH MICRO-CHANNEL COOLING

FIELD OF THE TECHNOLOGY

The present invention generally involves a combustor. More specifically, the invention relates to a combustor having a bundled tube type fuel nozzle assembly with micro-channels for cooling.

BACKGROUND

During operation of a gas turbine engine, pressurized air from a compressor flows into a head end volume defined within the combustor. The pressurized air flows from the head end volume into an inlet to a corresponding premix passage of a respective fuel nozzle. Fuel is injected into the flow of pressurized air within the premix passage where it mixes with the pressurized air so as to provide a fuel and air mixture to a combustion zone or chamber defined downstream from the fuel nozzle. The fuel and air mixture is burned in the combustion chamber to produce high temperature and high velocity combustion gases. The combustion gases travel from the combustion chamber to an inlet of a turbine portion of the gas turbine engine via a liner or duct that extends at least partially between the combustion chamber and the turbine inlet.

Particular combustion systems may include a bundled tube type fuel nozzle assembly having a plurality of tubes that extend through a forward or upstream plate and through an aft or downstream plate. Each tube extends through a respective opening defined in the aft plate. During operation, cooling air is routed through a gap defined between each tube and the respective opening, thereby providing cooling to a downstream end of the respective tube and to a portion of the aft plate.

Due to various obstructions such as fluid conduits and/or cartridges, it may not be feasible to space the tubes uniformly in all regions of the aft plate. Typically, in order to keep these regions adequately cooled, cooling holes are provided through the aft plate. Cooling air is routed through the cooling holes and into a combustion zone defined downstream from the tubes. However, this cooling scheme may have an undesirable effect on overall emissions performance of the combustor.

BRIEF DESCRIPTION OF THE TECHNOLOGY

Aspects and advantages are set forth below in the following description, or may be obvious from the description, or may be learned through practice.

One embodiment of the present disclosure is directed to a fuel nozzle assembly. The fuel nozzle assembly includes a forward plate and an aft plate which is axially spaced from the forward plate. The aft plate includes a first side surface and a second side surface. A cooling air plenum is defined within the bundled tube fuel nozzle assembly and is at least partially defined by the aft plate. A plurality of tubes extends through the forward plate, the cooling air plenum and the aft plate. A micro-cooling channel is disposed along the second side surface of the aft plate and is in fluid communication with the cooling air plenum and is in fluid communication with an exhaust aperture. A cover plate is connected to the aft plate and covers the micro-cooling channel.

Another embodiment of the present disclosure is a combustor. The combustor includes a fuel nozzle assembly that is coupled to a fuel supply via a fluid conduit. The fuel nozzle assembly includes a forward plate and an aft plate. The aft plate is axially spaced form the forward plate and includes a first side surface and a second side surface. An intermediate plate is disposed between the forward plate and the aft plate and a fuel plenum is defined therebetween. The intermediate plate and the aft plate define a cooling air plenum therebetween. The fuel plenum is in fluid communication with the fluid conduit and the cooling air plenum is in fluid communication with a cooling air supply. A plurality of tubes extends through the forward plate, the fuel plenum, the intermediate plate, the cooling air plenum and the aft plate. A micro-cooling channel is disposed along the second side surface of the aft plate. The micro-cooling channel is in fluid communication with the cooling air plenum via an inlet aperture which is disposed along the first side surface of the aft plate. The micro-cooling channel is also in fluid communication with an exhaust aperture. The fuel nozzle assembly further includes a cover plate. The cover plate is connected to the aft plate and covers the micro-cooling channel.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
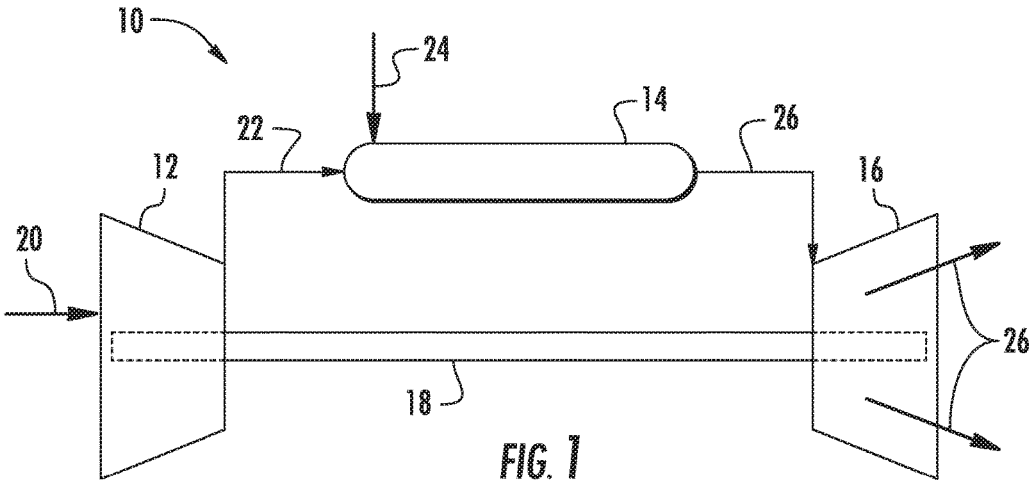
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a fuel nozzle assembly for a combustor of a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes a compressor 12, at least one combustor 14 disposed downstream of the compressor 12 and a turbine 16 disposed downstream of the combustor 14. Additionally, the gas turbine 10 may include one or more shafts 18 that couple the compressor 12 to the turbine 16.

During operation, air 20 flows into the compressor 12 where the air 20 is progressively compressed, thus providing compressed or pressurized air 22 to the combustor 14. At least a portion of the compressed air 22 is mixed with a fuel 24 within the combustor 14 and burned to produce combustion gases 26. The combustion gases 26 flow from the combustor 14 into the turbine 16, wherein energy (kinetic and/or thermal) is transferred from the combustion gases 26 to rotor blades (not shown), thus causing shaft 18 to rotate. The mechanical rotational energy may then be used for various purposes such as to power the compressor 12 and/or to generate electricity. The combustion gases 26 may then be exhausted from the turbine 16.

Figure 2:
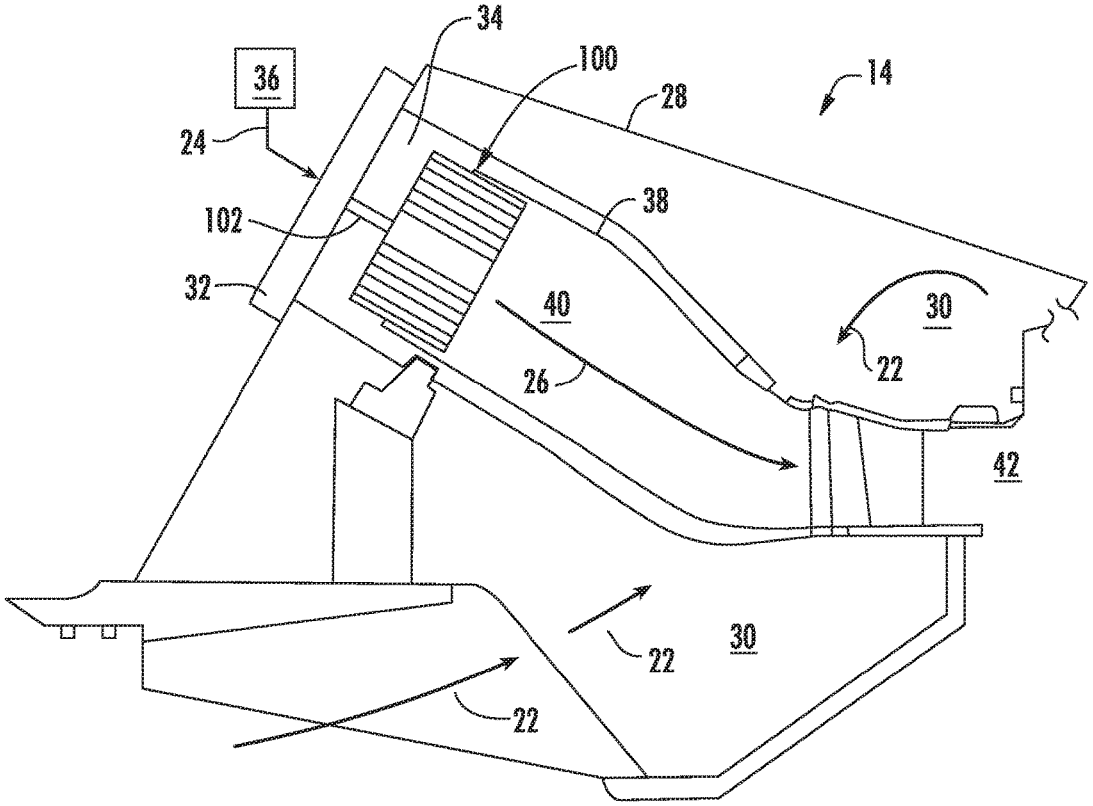
FIG. 2 is a cross sectional side view of an exemplary combustor 14 as may incorporate various embodiments of the present disclosure.

FIG. 2 is a cross sectional side view of an exemplary combustor 14 as may incorporate various embodiments of the present disclosure. As shown in FIG. 2, the combustor 14 may include an outer casing or compressor discharge casing 28 that at least partially forms a high pressure plenum 30 around various combustion hardware components. The high pressure plenum 30 is pressurized with a portion of the compressed air 22 from the compressor 12 (FIG. 1). The combustor 14 may also include an end cover 32 that is coupled to the outer casing 28. The end cover 32 and the outer casing 28 may at least partially define a head end volume 34 of the combustor 14. The head end volume 34 is in fluid communication with the high pressure plenum 30.

At least one fuel nozzle assembly 100 extends axially downstream from the end cover 32 and is in fluid communication with the head end volume 34 and with a fuel supply 36 via one or more fluid conduits 102 which provides the fuel 24 to the combustor 14. A duct or liner 38 extends downstream from the fuel nozzle assembly(s) 100. The duct 38 may at least partially define a combustion chamber or zone 40 downstream form the fuel nozzle assembly 100 and/or may at least partially define a hot gas path for routing the combustion gases 26 through the combustor 14 to an inlet 42 of the turbine 16.

Figure 3:
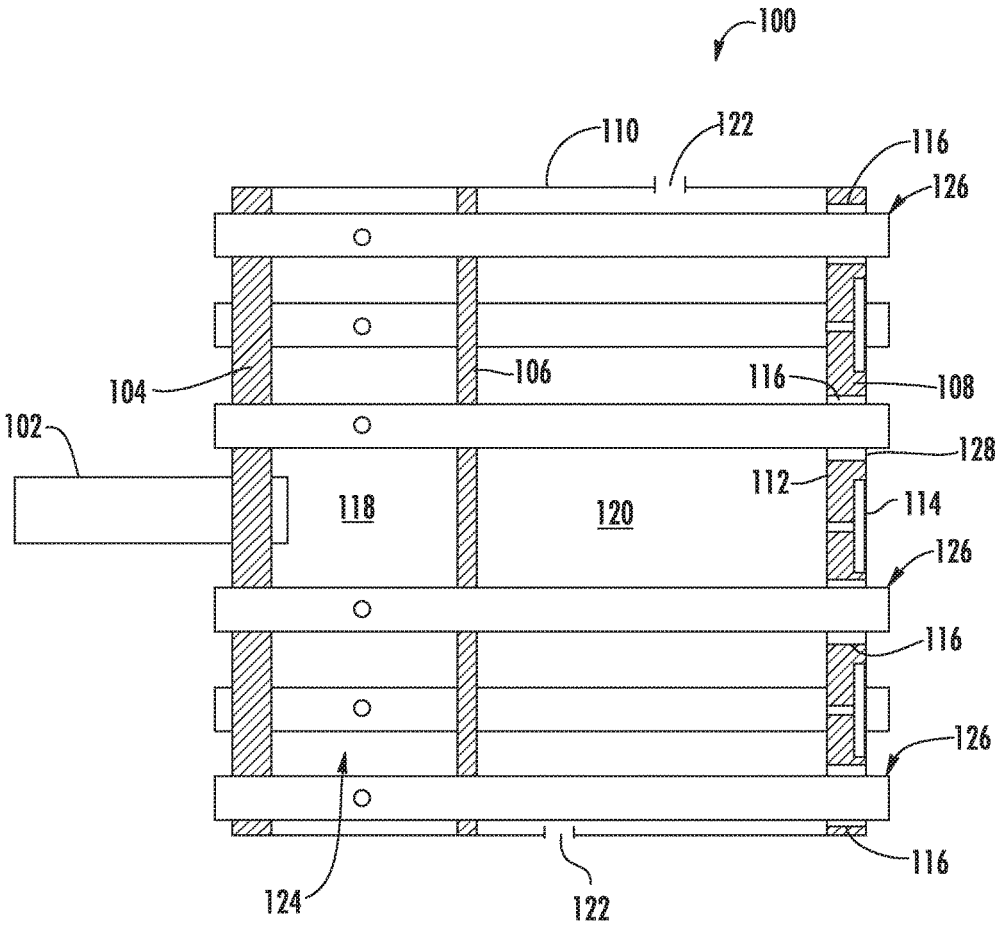
FIG. 3 is a cross-sectioned side view of an exemplary fuel nozzle assembly as may incorporate various embodiments of the present disclosure.

FIG. 3 provides a cross-sectional side view of an exemplary fuel nozzle assembly 100 as may incorporate various embodiments of the present disclosure. As shown in FIG. 3, the fuel nozzle assembly 100 includes a forward plate 104, an intermediate plate 106, an aft plate 108 and an outer band or sleeve 110 that extends between the forward plate 104 and the aft plate 108. The aft plate 108 includes a first or cool side surface 112 and a second or hot side surface 114. In particular embodiments, the aft plate 108 defines a plurality of tube openings 116.

A fuel plenum 118 is defined between the forward plate 104 and the intermediate plate 106. A cooling or purge air plenum 120 is defined between the intermediate plate 106 and the aft plate 108. In particular embodiments, the outer band 110 may define one or more openings 122 which provide for fluid flow into the cooling air plenum 120. A plurality of tubes 124 extends through the forward plate 104, the fuel plenum 118, the intermediate plate 106, the cooling air plenum 120 and the aft plate 108. A downstream end portion 126 of each tube 124 extends through a corresponding tube opening 116 of the plurality of tube openings 116. In particular embodiments, a gap 128 is formed between each tube 124 and the respective tube opening 116. The fluid conduit 102 extends through and/or is connected to the forward plate 104 and provides fuel 24 to the fuel plenum 118.

Figure 4:
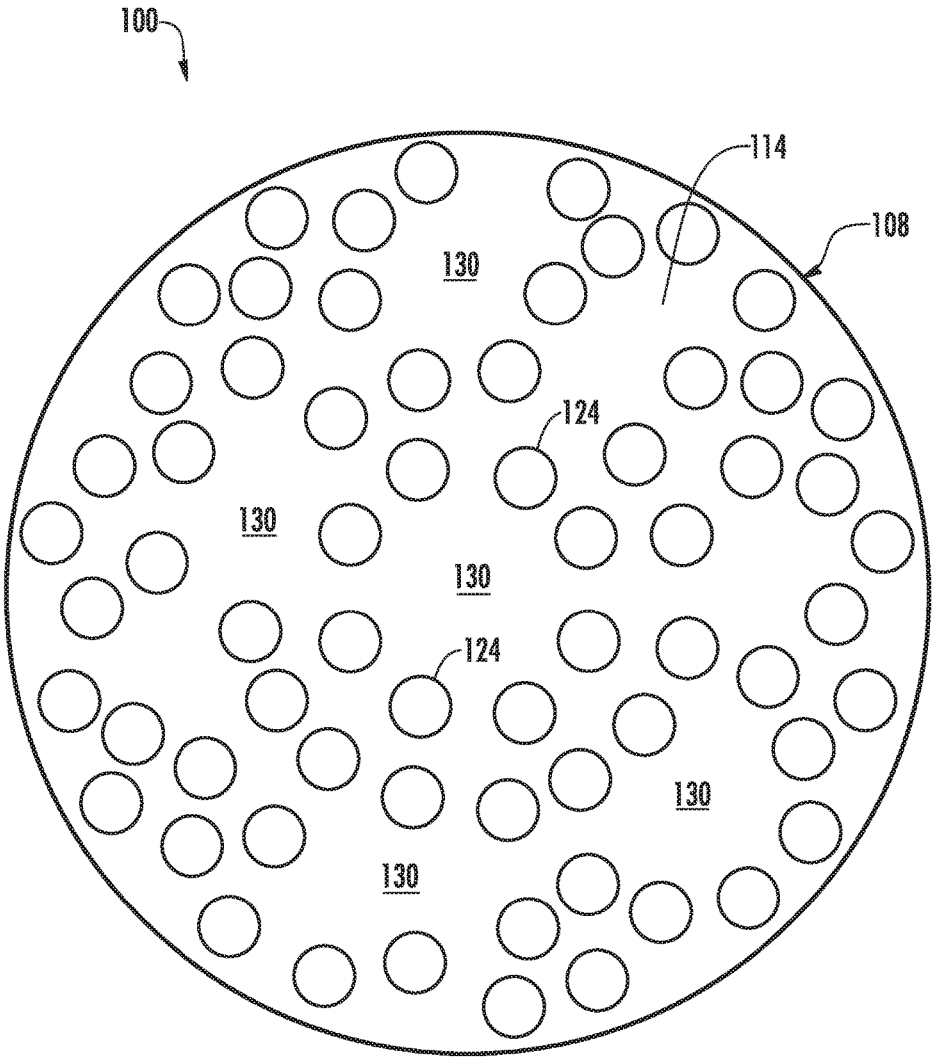
FIG. 4 is an upstream view of the fuel nozzle assembly as shown in FIG. 3, according to at least one embodiment of the present disclosure.

FIG. 4 provides an upstream view of the fuel nozzle assembly 100 as shown in FIG. 3, according to at least one embodiment of the present disclosure. As shown in FIG. 3, the tubes 124 may be arranged or spaced around the fluid conduit 102 or other obstruction such as a fuel or purge air cartridge (not shown). As such, as shown in FIG. 4, relatively large solid or continuous areas or regions 130 of the second side 114 of the aft plate 108 are created between adjacent tubes 124 surrounding the fluid conduit 102 or other obstruction.

Figure 5:
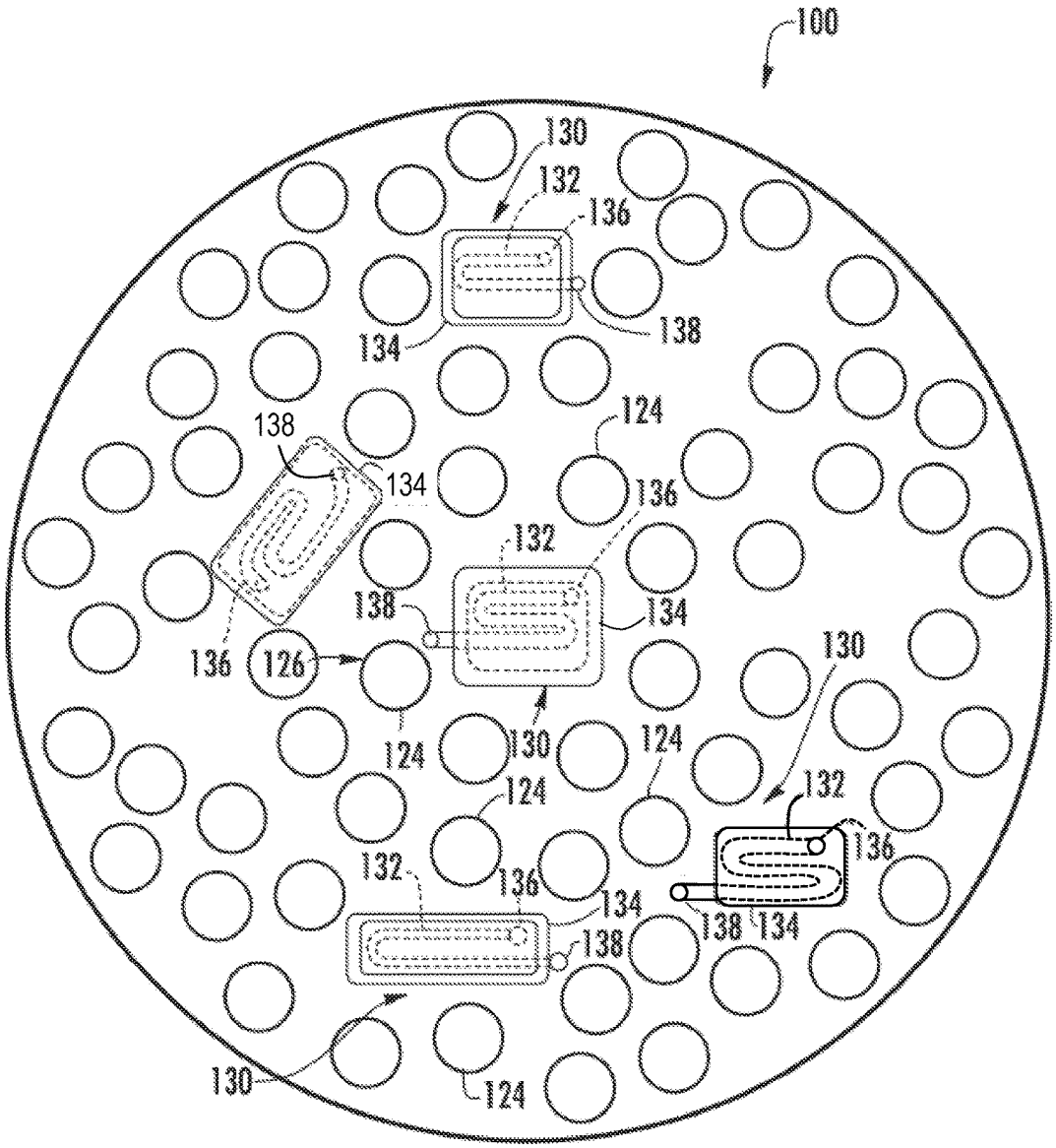
FIG. 5 is an upstream view of the fuel nozzle assembly as shown in FIG. 4, according to at least one embodiment of the present disclosure.

FIG. 5 provides an upstream view of the fuel nozzle assembly 100 as shown in FIG. 4, according to at least one embodiment of the present disclosure. As shown in FIG. 5, the fuel nozzle assembly 100 includes at least one but typically a plurality of the micro-cooling channels 132 as illustrated in hidden or dashed lines and at least one but typically a plurality of cover plates 134 which cover the micro-cooling channel(s) 132. In various embodiments, the micro-cooling channel 132 may be disposed between adjacent tubes 124 of the plurality of tubes 124 in the solid or continuous areas or regions 130 defined along the aft plate 108. In particular embodiments, as shown in FIG. 5, a plurality of micro-cooling channels 132 is dispersed across or along the aft plate 108 at various solid or continuous areas or regions 130. The micro-cooling channels 132 are covered by a plurality of cover plates 134.

Figure 6:
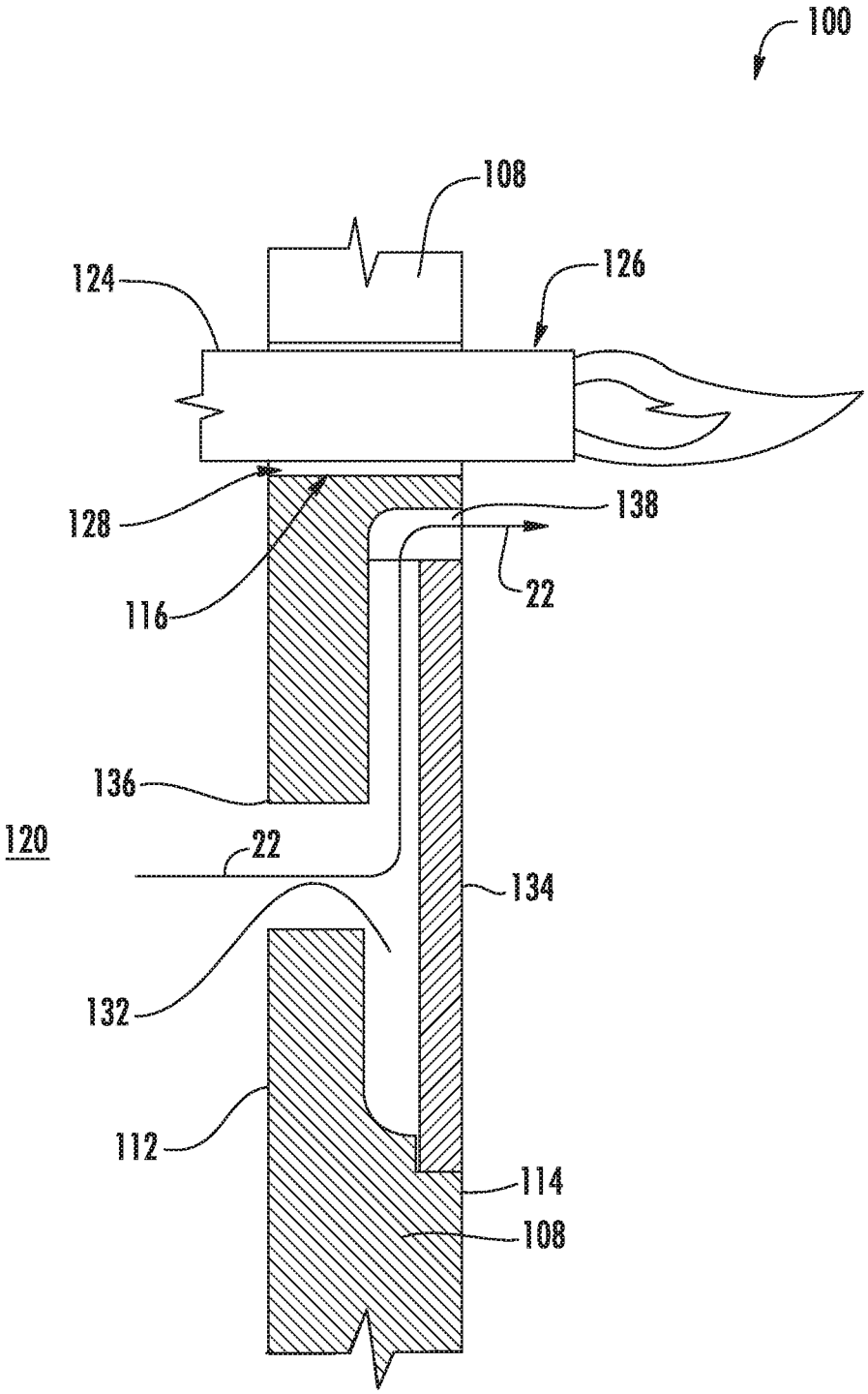
FIG. 6 is a cross-sectioned side view of a portion of an exemplary aft plate and an exemplary tube of the fuel nozzle assembly as shown in FIG. 3, according to at least one embodiment of the present disclosure.

FIG. 6 provides a cross-sectioned view of a portion of the aft plate and a tube 124 of the plurality of tubes 124 according to at least one embodiment of the present disclosure. In particular embodiments, as shown collectively in FIGS. 5 and 6, the aft plate 108 defines at least one but typically a plurality of micro-cooling channels 132 disposed along the second side surface 114 of the aft plate 108. A cover plate 134 is connected to the aft plate 108 and covers or encases the micro-cooling channel 132. As shown in collectively in FIGS. 5 and 6, each of the micro-cooling channels 132 is in fluid communication with the cooling air plenum 120 via one or more inlet apertures 136. The inlet apertures 136 may be at least partially defined by the aft plate 108 and may be disposed along the first side surface 112. Each micro-cooling channel 132 is in fluid communication with at least one exhaust aperture 138 disposed along the second side surface 114 of the aft plate 108. In particular embodiments, at least one exhaust aperture 138 is defined by the aft plate 108 proximate to a downstream end portion 126 of a respective tube 124. In particular embodiments, at least one exhaust aperture 138 is defined by a respective cover plate 134.

The plurality of micro-cooling channels 132 may be the same or different in size or shape from each other. For example, in particular embodiments, one or more micro-cooling channels 132 of the plurality of micro-cooling channels 132 extends in a serpentine pattern. In particular embodiments, one or more micro-cooling channels 132 of the plurality of micro-cooling channels 132 extends in a substantially linear manner. In particular embodiments, at least one micro-cooling channel 132 extends in a serpentine pattern and at least one micro-cooling channel 132 extends in a substantially linear manner. In particular embodiments, as shown in FIG. 6, at least one micro-cooling channel 132 is formed in the second side surface 114 of the aft plate 108 beneath the cover plate 134.

Figure 7:
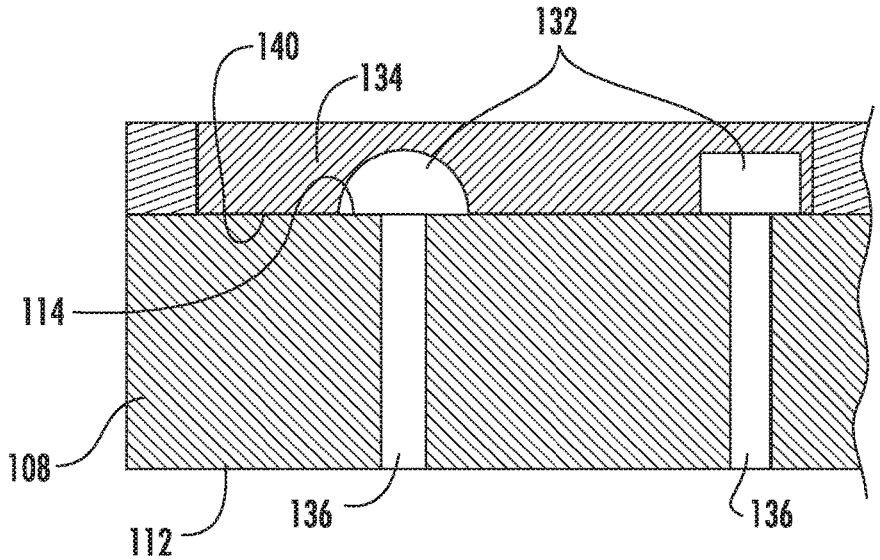
FIG. 7 is a cross-sectioned view of a portion of the aft plate and a portion of the cover plate as shown in FIG. 6, according to at least one embodiment of the present disclosure.
Figure 8:
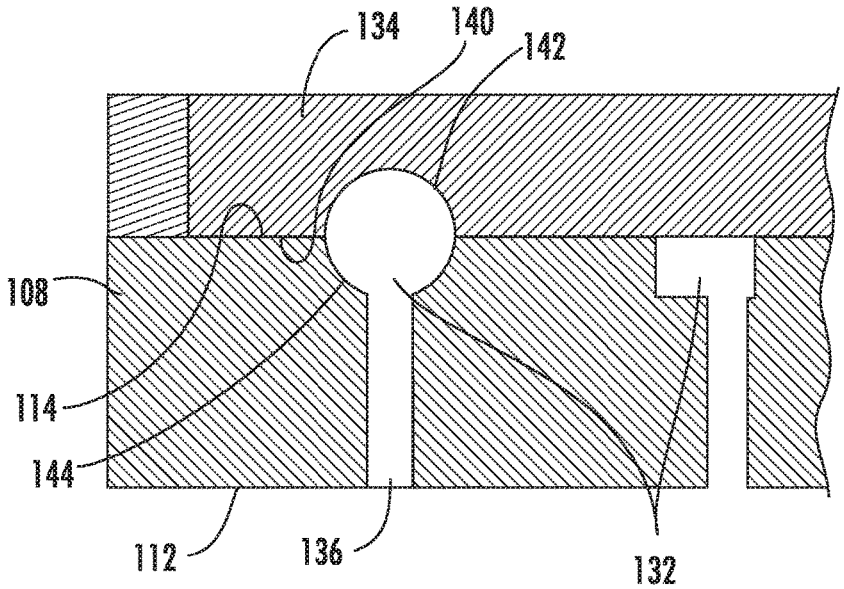
FIG. 8 is a cross-sectioned view of a portion of the aft plate and a portion of the cover plate as shown in FIG. 6, according to at least one embodiment of the present disclosure.

FIG. 7 illustrates a portion of the aft plate 108 and a portion of an exemplary cover plate 134 according to at least one embodiment of the present disclosure. FIG. 8 illustrates a portion of the aft plate 108 and a portion of an exemplary cover plate 134 according to at least one embodiment of the present disclosure. In particular embodiments, as shown in FIG. 7, the plurality of micro-cooling channels 132 may be defined in or formed along an inner surface 140 of the cover plate(s) 134. In particular embodiments, as shown in FIG. 8, a first portion 142 of at least one more micro-cooling channel 132 may be defined in or formed along the inner surface 140 of the cover plate(s) 134 and a second portion 144 of the micro-cooling channel 132 may be defined in or formed along the second side surface 114 of the aft plate 108.

In accordance with certain embodiments, the plurality of micro-cooling channels 132 may have a width of between about 100 microns (μm) and about 3 millimeters (mm) and a depth between about 100 μm and about 3 mm, as will be discussed below. For example, the plurality of micro-cooling channels 132 may have a width and/or depth between about 150 μm and about 1.5 mm, between about 250 μm and about 1.25 mm, or between about 300 μm and about 1 mm.

In certain embodiments, the plurality of micro-cooling channels 132 may have a width and/or depth of less than about 50, 100, 150, 200, 250, 300, 350, 400, 450, 500, 600, 700, or 750 μm. The plurality of micro-cooling channels 132 may have circular, semi-circular, oval, curved, rectangular, triangular, or rhomboidal cross-sections. The preceding list is merely illustrative and is not intended to be exhaustive. The width and depth could vary throughout its length. Additionally, in certain embodiments, the plurality of micro-cooling channels 132 may have varying cross-sectional areas. Heat transfer enhancements such as turbulators or dimples may be installed in one or more of the micro-cooling channels 132 as well.

In various embodiments, as shown in FIGS. 6 through 8 collectively, the cover plate 134 is disposed over a portion of the second side surface 114 of the aft plate 108, and more specifically over the plurality of micro-cooling channels 132 to at least partially enclose the plurality of micro-cooling channels 132 therebetween. The cover plate 134 is shaped in such a way to form a flush engagement with the second side surface 114 of the aft plate 108. A flush engagement provides effective sealing and enclosure of the plurality of micro-cooling channels 132. It is contemplated that the plurality of micro-cooling channels 132 is formed in the cover plate 134 as an alternative to, or in combination with, micro-cooling channels formed in the second side surface 114 of the aft plate 108.

The cover plate 134 may be formed of various suitable materials. In one embodiment, the cover plate 134 comprises a pre-sintered preform (PSP). In another embodiment, the cover plate 134 comprises one or more layers of sheet metal. It is further contemplated that the cover plate 134 may be formed of both PSP foil(s) and one or more layers of sheet metal.

The pre-sintered preform may comprise a mixture of particles comprising a base alloy and a second alloy that have been sintered together at a temperature below their melting points to form an agglomerate and somewhat porous mass. Suitable particle size ranges for the powder particles include 150 mesh, or even 325 mesh or smaller to promote rapid sintering of the particles and minimize porosity in the pre-sintered preform to about 10 volume percent or less. In some embodiments, the density of the pre-sintered preform has a density of 90% or better. In even some embodiments, the pre-sintered preform has a density of 95% or better. As discussed below, the pre-sintered preform can be subjected to hot isostatic pressing (HIP) or vacuum/inert atmosphere pressing to promote higher densities.

The base alloy of the pre-sintered preform can comprise any composition such as one similar to the aft plate 108 to promote common physical properties between the pre-sintered preform and the aft plate 108. For example, in some embodiments, the base alloy and the aft plate 108 share a common composition (i.e., they are the same type of material). In some embodiments, the base alloy can comprise nickel-based superalloys such as Rene N4, Rene N5, Rene 108, GTD-111®, GTD-222®, GTD-444®, IN-738 and MarM 247 or cobalt-based superalloys such as FSX-414 as discussed above. In some embodiments, the properties for the base alloy include chemical and metallurgical compatibility with the base article, such as high fatigue strength, low tendency for cracking, oxidation resistance and/or machinability.

In some embodiments, the base alloy may comprise a melting point of within about 25° C. of the melting temperature of the aft plate 108. In some embodiments, the base alloy may comprise a compositional range of, by weight, about 2.5 to 11% cobalt, 7 to 9% chromium, 3.5 to 11% tungsten, 4.5 to 8% aluminum, 2.5 to 6% tantalum, 0.02 to 1.2% titanium, 0.1 to 1.8% hafnium, 0.1 to 0.8% molybdenum, 0.01 to 0.17% carbon, up to 0.08% zirconium, up to 0.60 silicon, up to 2.0 rhenium, the balance nickel and incidental impurities. In even some embodiments, the base alloy may comprise a compositional range of, by weight, about 9 to 11% cobalt, 8 to 8.8% chromium, 9.5 to 10.5% tungsten, 5.3 to 5.7% aluminum, 2.8 to 2.3% tantalum, 0.9 to 1.2% titanium, 1.2 to 1.6% hafnium, 0.5 to 0.8% molybdenum, 0.13 to 0.17% carbon, 0.03 to 0.08% zirconium, the balance nickel and incidental impurities. It should be appreciated that while specific materials and compositions have been listed herein for the composition of the base alloy of the pre-sintered preform, these listed materials and compositions are exemplary only and non-limiting and other alloys may alternatively or additionally be used. Furthermore, it should be appreciated that the particular composition of the base alloy for the pre-sintered preform may depend on the composition of the aft plate 108.

As discussed above, the pre-sintered preform further comprises a second alloy. The second alloy may also have a composition similar to the aft plate 108 but further contain a melting point depressant to promote sintering of the base alloy and the second alloy particles and enable bonding of the pre-sintered preform to the aft plate 108 at temperatures below the melting point of the aft plate 108. For example, in some embodiments the melting point depressant can comprise boron and/or silicon.

In some embodiments, the second alloy may comprise a melting point of about 25° C. to about 50° C. below the grain growth or incipient melting temperature of the aft plate 108. Such embodiments may better preserve the desired microstructure of the aft plate 108 during the heating process. In some embodiments, the second alloy may comprise a compositional range of, by weight, about 9 to 10% cobalt, 11 to 16% chromium, 3 to 4% aluminum, 2.25 to 2.75% tantalum, 1.5 to 3.0% boron, up to 5% silicon, up to 1.0% yttrium, the balance nickel and incidental impurities. For example, in some embodiments the second alloy may comprise commercially available Amdry DF4B nickel brazing alloy. It should also be appreciated that while specific materials and compositions have been listed herein for the composition of the second alloy of the pre-sintered preform, these listed materials and compositions are exemplary only and non-limiting and other alloys may alternatively or additionally be used. Furthermore, it should be appreciated that the particular composition of the second alloy for the pre-sintered preform may depend on the composition of the aft plate 108.

The pre-sintered preform can comprise any relative amounts of the base alloy and the second alloy that are sufficient to provide enough melting point depressant to ensure wetting and bonding (e.g., diffusion/brazing bonding) of the particles of the base alloy and the second alloy to each other and to the outer surface 26 of the aft plate 108. For example, in some embodiments the second alloy can comprise at least about 10 weight percent of the pre-sintered preform. In some embodiments the second alloy can comprise no more than 70 weight percent of the pre-sintered preform. Such embodiments may provide a sufficient amount of melting point depressant while limiting potential reduction of the mechanical and environmental properties of the subsequent heating. Furthermore, in these embodiments, the base alloy can comprise the remainder of the pre-sintered preform (e.g., between about 30 weight percent and about 70 weight percent of the pre-sintered preform). In even some embodiments, the particles of the base alloy can comprise about 40 weight percent to about 70 weight percent of the pre-sintered preform with the balance of the composition comprising particles of the second alloy. It should be appreciated that while specific relative ranges of the base alloy and the second alloy have been presented herein, these ranges are exemplary only and non-limiting and any other relative compositions may also be realized such that a sufficient amount of melting point depressant is provided as discussed above.

Aside from the particles of the base alloy and the second alloy, no other constituents may be required within the pre-sintered preform. However, in some embodiments, a binder may be initially blended with the particles of the base alloy and the second alloy to form a cohesive mass that can be more readily shaped prior to sintering. In such embodiments, the binder can include, for example, a binder commercially available under the name NICROBRAZ-S from the Wall Colmonoy Corporation. Other potentially suitable binders include NICROBRAZ 320, VITTA GEL from Vitta Corporation, and others including adhesives commercially available from Cotronics Corporation, all of which may volatilize cleanly during sintering.

In some embodiments, the pre-sintered preform may actually comprise a plurality of layers, each being attached to each other before or after being connected to the aft plate 108. In such embodiments, the plurality of layers may combine to form one or more micro-cooling channels 132 of the plurality of micro-cooling channels 132 or a single layer may comprise one or more micro-cooling channels 132 of the plurality of micro-cooling channels 132 while additional layers are present for additional protection of the aft plate 108. Such embodiments may also allow for specific thermal properties in different zones of the pre-sintered preform to be individually tailored. In even some embodiments, the pre-sintered preform may be combined with one or more metal layers or sections. For example, the pre-sintered preform may form the sides of the one or more micro-cooling channels 132 of the plurality of micro-cooling channels 132 while a thin metal film closes off the top of the respective micro-cooling channel 132. In such embodiments, the metal film may be bonded prior to, after or while the pre-sintered preform is bonded to the aft plate 108. Or, in some embodiments, the pre-sintered preform may bond with the aft plate 108 via one or more additional metal layers.

In operation, a cooling medium such as the compressed air 22 from the compressor 12, enters at least one inlet aperture 136 and flows through at least one micro-cooling channel 132 defined beneath a respective cover plate 134, thereby transferring thermal energy provided by the combustion gases 26 away from the aft plate 108. In particular embodiments, a portion or all of the cooling medium may be exhausted from the at least one micro-cooling channel 132 into the combustion chamber 40 proximate to a corresponding exhaust aperture 138 disposed proximate to a downstream end of a respective tube 124. In this manner, the exhausted cooling air may more thoroughly mix with cooling air flowing through a corresponding gap 128 between the respective tube 124 and the aft plate, thus potentially reducing overall NOx formation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel nozzle assembly, comprising:

a forward plate;

an aft plate having a first side surface proximate to the forward plate and a second side surface opposite the first side surface, wherein the aft plate is axially spaced from the forward plate and defines an upstream boundary of a combustion zone;

a cooling air plenum defined within the fuel nozzle assembly and partially defined by the aft plate;

a plurality of tubes extending through the forward plate, the cooling air plenum and the aft plate;

a micro-cooling channel disposed in a localized area along the second side surface of the aft plate, wherein the micro-cooling channel is in fluid communication with the cooling air plenum, and wherein the micro-cooling channel is in fluid communication with an exhaust aperture; and a cover plate connected to the aft plate and covering only the localized area in which the micro-cooling channel is disposed.

2. The fuel nozzle assembly as in claim 1, wherein the micro-cooling channel is formed in the second side surface of the aft plate beneath the cover plate.

3. The fuel nozzle assembly as in claim 1, wherein the micro-cooling channel is formed in an inner surface of the cover plate.

4. The fuel nozzle assembly as in claim 1, wherein a portion of the micro-cooling channel is partially formed in the aft plate and partially formed in an inner surface of the cover plate.

5. The fuel nozzle assembly as in claim 1, wherein the cover plate comprises a pre-sintered preform.

6. The fuel nozzle assembly as in claim 1, wherein the cover plate comprises one or more layers of sheet metal.

7. The fuel nozzle assembly as in claim 1, wherein an outer surface of the cover plate is flush with the second side surface of the aft plate.

8. The fuel nozzle assembly as in claim 1, wherein the micro-cooling channel is formed in a serpentine pattern.

9. The fuel nozzle assembly as in claim 1, wherein the aft plate defines an inlet aperture disposed along the first side surface of the aft plate, wherein the inlet aperture provides for fluid communication between the cooling air plenum and the micro-cooling channel.

10. The fuel nozzle assembly as in claim 1, wherein the exhaust aperture is defined by the cover plate.

11. The fuel nozzle assembly as in claim 1, wherein the exhaust aperture is defined by the aft plate.

12. The fuel nozzle assembly as in claim 1, wherein the exhaust aperture is disposed proximate to a tube of the plurality of tubes.

13. A combustor, comprising:

a fuel nozzle assembly coupled to a fuel supply via a fluid conduit, the fuel nozzle assembly comprising:

a forward plate;

an aft plate having a first side surface proximate to the forward plate and a second side surface opposite the first side surface, wherein the aft plate is axially spaced from the forward plate and defines an upstream boundary of a combustion zone;

an intermediate plate disposed between the forward plate and the aft plate, wherein the forward plate and the intermediate plate define a fuel plenum therebetween, wherein the intermediate plate and the aft plate define a cooling air plenum therebetween, wherein the fuel plenum is in fluid communication with the fluid conduit and the cooling air plenum is in fluid communication with a cooling air supply;

a plurality of tubes that extends through the forward plate, the fuel plenum, the intermediate plate, the cooling air plenum and the aft plate;

a micro-cooling channel disposed in a localized area along the second side surface of the aft plate, wherein the micro-cooling channel is in fluid communication with the cooling air plenum via an inlet aperture disposed along the first side surface of the aft plate, and wherein the micro-cooling channel is in fluid communication with an exhaust aperture; and a cover plate connected to the aft plate and covering only the localized area in which the micro-cooling channel is disposed.

14. The combustor as in claim 13, wherein the micro-cooling channel is formed in the second side surface of the aft plate beneath the cover plate.

15. The combustor as in claim 13, wherein the micro-cooling channel is formed in an inner surface of the cover plate.

16. The combustor as in claim 13, wherein a portion of the micro-cooling channel is partially formed in the aft plate and partially formed in an inner surface of the cover plate.

17. The combustor as in claim 13, wherein the cover plate comprises at least one of a pre-sintered preform and one or more layers of sheet metal.

18. The combustor as in claim 13, wherein an outer surface of the cover plate is flush with the second side surface of the aft plate.

19. The combustor as in claim 13, wherein the micro-cooling channel is formed in a serpentine pattern.

20. The combustor as in claim 13, wherein the exhaust aperture is defined by the cover plate or the aft plate, proximate to a tube of the plurality of tubes.

* * * * *